US009126706B2

(12) United States Patent
Rodriguez et al.

(10) Patent No.: US 9,126,706 B2
(45) Date of Patent: Sep. 8, 2015

(54) APPARATUS AND METHODS FOR PRINTER SYSTEM FILTER PACKAGING

(75) Inventors: Jorge Mario Rodriguez, Webster, NY (US); Glenn David Batchelor, Fairport, NY (US); Ali R. Dergham, Fairport, NY (US); Christopher G. Donnelly, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 801 days.

(21) Appl. No.: 13/359,479

(22) Filed: Jan. 26, 2012

(65) Prior Publication Data

US 2013/0192169 A1 Aug. 1, 2013

(51) Int. Cl.

| | |
|---|---|
| ***B65B 11/00*** | (2006.01) |
| ***B65B 11/48*** | (2006.01) |
| ***B65B 43/10*** | (2006.01) |
| ***B65D 77/04*** | (2006.01) |
| *B65D 5/66* | (2006.01) |
| *B65D 5/46* | (2006.01) |

(52) U.S. Cl.

CPC ..... *B65B 11/48* (2013.01); *B65B 43/10* (2013.01); *B65D 5/46088* (2013.01); *B65D 77/042* (2013.01); *B65D 5/46104* (2013.01); *B65D 5/6614* (2013.01)

(58) Field of Classification Search

USPC ..... 229/117.15, 117.09, 148; 206/163

See application file for complete search history.

(56) References Cited

U.S. PATENT DOCUMENTS

| | | | | |
|---|---|---|---|---|
| 659,238 | A * | 10/1900 | Killinger | 229/117.13 |
| 3,283,950 | A * | 11/1966 | Bolding | 206/167 |
| 8,408,682 | B2 * | 4/2013 | Platt et al. | 347/67 |
| 2004/0226989 | A1 * | 11/2004 | Cook et al. | 229/114 |
| 2006/0202005 | A1 * | 9/2006 | Andrews et al. | 229/117.3 |
| 2007/0259220 | A1 * | 11/2007 | Redmond | 429/12 |
| 2011/0253774 | A1 * | 10/2011 | Hill et al. | 229/117.3 |

* cited by examiner

*Primary Examiner* — Christopher Demeree

(74) *Attorney, Agent, or Firm* — Ronald E. Prass, Jr.; Prass LLP

(57) ABSTRACT

A printer filter packaging apparatus includes a base for supporting a filter having delicate filter media. Side wraps extend from two opposite sides of the base and cover two opposite sides of the filter. A rear wrap includes a handle, and covers a rear and a top of the filter. A front wrap defines a slit for receiving the handle; the front wrap covers the top and a front of the filter. The wrapped or covered filter may be lifted by the handle, the filter being supported by a combination of the base and front, rear, and side wraps.

19 Claims, 5 Drawing Sheets

APPARATUS AND METHODS FOR PRINTER SYSTEM FILTER PACKAGING

FIELD OF DISCLOSURE

The disclosure relates to apparatus and methods for filter packaging. In particular, the disclosure relates to apparatus and methods for packaging a filter for a printing system.

BACKGROUND

Printer systems may require filters for cyclone dirt collection systems, for example, and/or filtering circulating air from residual toner or dirt. Exemplary filters, such as those used in Xerox's iGen systems, may comprise a sensitive surface having delicate, flame retardant borosilicate glass, for example. Filters may require replacement from time to time, and are a consumable product that must be packaged and shipped to requesting customers.

SUMMARY

It has been found that printing system failures may result from filter failure. Further, it has been found that filter failure may result from damage caused to the filter during packaging, shipping, and unpacking. Effective and efficient packaging apparatus and methods are desired that minimize damage done to filters during packaging, shipping, and unpacking.

In an embodiment, filter packaging apparatus may include a base, the base having a substantially planar surface configured for supporting a filter, the base having a first side, a second side, a third side, and fourth side; a side wrap extending from the first side of the base, the side wrap defining a first slit; a rear wrap extending from the second side of the base; a front wrap extending from the fourth side of the base, the fourth side being opposite from the second side, the front wrap defining a second slit; and a handle, the handle being configured for holding a filter wrapped in the filter packaging apparatus, the handle being attached to the rear wrap.

In an embodiment, packaging apparatus may include the side wrap being configured for wrapping the filter by covering a first side of the filter, a top of the filter, and a second side of the filter, the second side of the filter being opposite from the first side of the filter.

In an embodiment, packaging apparatus may include the first slit being configured to receive the handle, wherein when the side wrap covers the top of the filter and the rear wrap covers the top of the filter, the side wrap and the filter are interposed by the rear wrap.

In an embodiment, packaging apparatus may include the second slit being configured to receive the handle, wherein when the side wrap covers the top of the filter, the front wrap covers the top of the filter, and the rear wrap covers the top of the filter, the front wrap interposes the side wrap and the rear wrap.

In an embodiment, packaging apparatus may include the side wrap being configured to contact two sides of the filter when the side wrap contacts the top of the filter. In an embodiment, packaging apparatus may include the base being configured to support the filter, the filter having filter media comprising flame retardant borosilicate glass.

In an embodiment, filter packaging apparatus may include a base, the base having a substantially planar surface configured for supporting a filter, the base having a first side, a second side, a third side, and fourth side; a first side wrap extending from the first side of the base; a second side wrap extending from a third side of the base, the third side of base being opposite from the first side of the base; a rear wrap extending from a second side of the base; a front wrap extending from the fourth side of the base, the fourth side being opposite from the second side, the front wrap defining a slit; and a handle, the handle being configured for holding a filter wrapped in the filter packaging apparatus, the handle being attached to the rear wrap.

In an embodiment, packaging apparatus may include the first side wrap being configured for wrapping the filter by covering at least a first side of the filter and the second side wrap being configured for wrapping the filter by covering at least a third side of the filter, the third side of the filter being opposite from a first side of the filter.

In an embodiment, packaging apparatus may include the slit being configured to receive the handle, wherein when the front wrap covers the top of the filter and the rear wrap covers the top of the filter, the front wrap interposing the rear wrap and the filter. In an embodiment, packaging apparatus may include the first side wrap being configured to contact the first side and the top of the filter. In an embodiment, the base may be configured to support the filter, the filter having filter media comprising flame retardant borosilicate glass.

In an embodiment, methods for packaging a filter placed on a base of a filter wrap packaging apparatus may include wrapping a rear wrap over the filter, the rear wrap extending from a second side of the base, the rear wrap having a handle; wrapping a front wrap over the filter, the front wrap extending from a fourth side of the base, the front wrap defining a first slit that receives the handle, the fourth side of the base being opposite from the second side of the base; and wrapping a side wrap over the filter, the side wrap defining a second slit that receives the handle, the front wrap interposing the filter and the side wrap, the rear wrap interposing the front wrap and the filter. In an embodiment, methods may include inserting the wrapped filter into an outer carton using the handle.

In an embodiment, methods for unpacking a filter placed on a base of a packaging apparatus may include unwrapping a side wrap from the filter, the side wrap defining a second slit that receives a handle; unwrapping a front wrap from the filter, the front wrap extending from a fourth side of the base, the front wrap defining a first slit that receives the handle; and unwrapping a rear wrap from the filter, the rear wrap extending from a second side of the base, the rear wrap having the handle. In an embodiment, methods may include removing the wrapped filter from an outer carton using the handle.

In an embodiment, methods for packaging a filter placed on a base of a filter wrap packaging apparatus may include wrapping a first side wrap over a first side of the filter, the first side wrap extending from a first side of the base; wrapping a second side wrap over a second side of the filter, the second side wrap extending from a third side of the base, the third side of the base being opposite from a first side of the base; wrapping a rear wrap over the filter, the rear wrap extending from a second side of the base, the rear wrap having a handle; and wrapping a front wrap over the filter, the front wrap extending from a fourth side of the base, the front wrap defining a slit, the slit being configured to receive the handle. In an embodiment, methods may include inserting the wrapped filter into an outer carton using the handle.

In an embodiment, methods for unpacking a filter placed on a base of a packaging apparatus may include unwrapping a front wrap from the filter, the front wrap defining a slit, the slit being configured for receiving a handle; unwrapping a rear wrap from the filter, the rear wrap having the handle; and unwrapping a first side wrap and a second side wrap from the filter. In an embodiment, methods may include removing the wrapped filter from an outer carton using the handle. In an embodiment, methods may include removing a protective covering from the unwrapped filter, the filter being supported by the base.

Exemplary embodiments are described herein. It is envisioned, however, that any system that incorporates features of apparatus and systems described herein are encompassed by the scope and spirit of the exemplary embodiments.

DETAILED DESCRIPTION

Figure 1A:
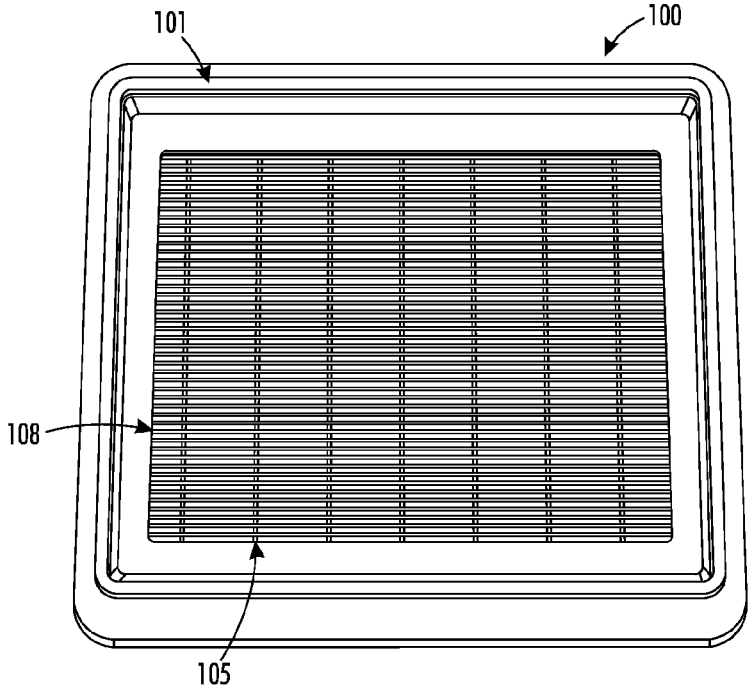
FIG. 1A shows a diagrammatical top view of a filter having delicate media for printing systems.

Exemplary embodiments are intended to cover all alternatives, modifications, and equivalents as may be included within the spirit and scope of the apparatus and methods as described herein.

Reference is made to the drawings to accommodate understanding of delicate filer packaging apparatus and methods. In the drawings, like reference numerals are used throughout to designate similar or identical elements. The drawings depict various embodiments of illustrative delicate filter packaging apparatus and methods.

Printing system failures may result from filter failure. Filter failure may result from damage caused to the filter during packaging, shipping, and unpacking. For example, filter media packaged in related art packaging using related art methods is susceptible to damage including torn pleats, split pleats, and drag marks caused by deformed pleats.

The damage may arise when filters are packaged and shipped. Damage may also arise during unpacking. For example, a surface of the filter comprising the filter media typically closely faces portions of packaging material that a customer manipulates to remove the packaging. Accordingly, a customer's hands may damage filter media during unpacking. A filter may be damaged by a customer attempting to remove the filter from within a box by handling the filter edges, and accidentally puncturing the filter media, for example. A filter is typically packaged in a protective coating such as a plastic bag, and a customer may drop the filter while opening the plastic bag, or drop the filter while attempting to grasp the filter during removal of the filter form a box.

Filter packaging apparatus and methods in accordance with embodiments may prevent damage to delicate filter media during packaging, shipping, storage, and unpacking. FIG. 1A shows a filter 100 for use in a printing system. In particular, FIG. 1A shows a filter 100 for an iGEN printing system. Other filters for which apparatus and methods may be applicable may have a configuration similar to that of the iGen environmental Unit (EU) Hepa and ozone catalytic media filters, for example. The filter 100 includes a filter assembly 101, and a filter media 105 framed and supported by the filter assembly 101.

Figure 1B:
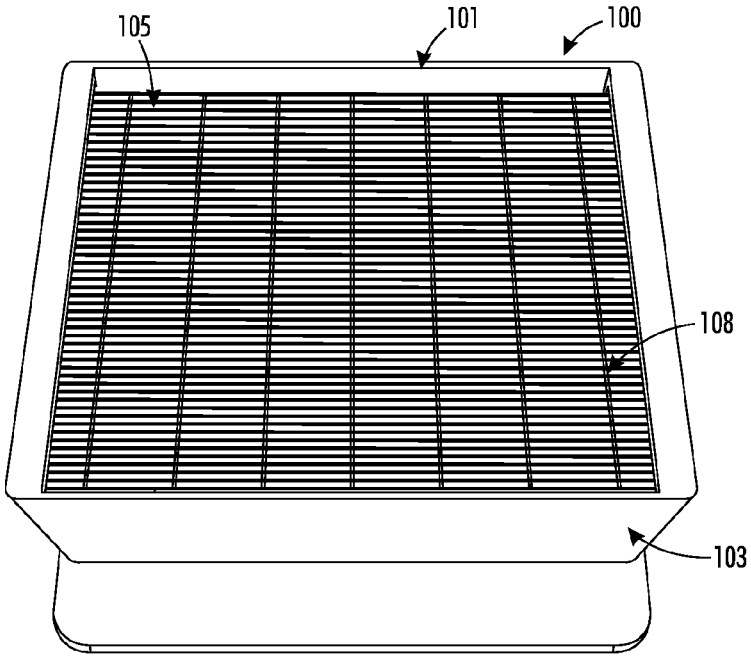
FIG. 1B shows a diagrammatical top perspective view of a filter having delicate media for printing systems.

The filter media 105 may be configured to form pleats 108, for example. The filter media may comprise a delicate, flame retardant borosilicate glass, or other similar material. FIG. 1B shows a top perspective view of the filter 100 shown in FIG. 1A. In particular, FIG. 1B shows the filter assembly 101 supporting a filter media 105 that is configured to form pleats 108. The filter media 105 forms a top surface of the filter 100. A side surface 103 may be configured to support the portion of the assembly 101 that supports the filter media 105. During packaging, shipping, and unpacking, a customer may damage the delicate filter media 105 and pleats 108.

Figure 2:
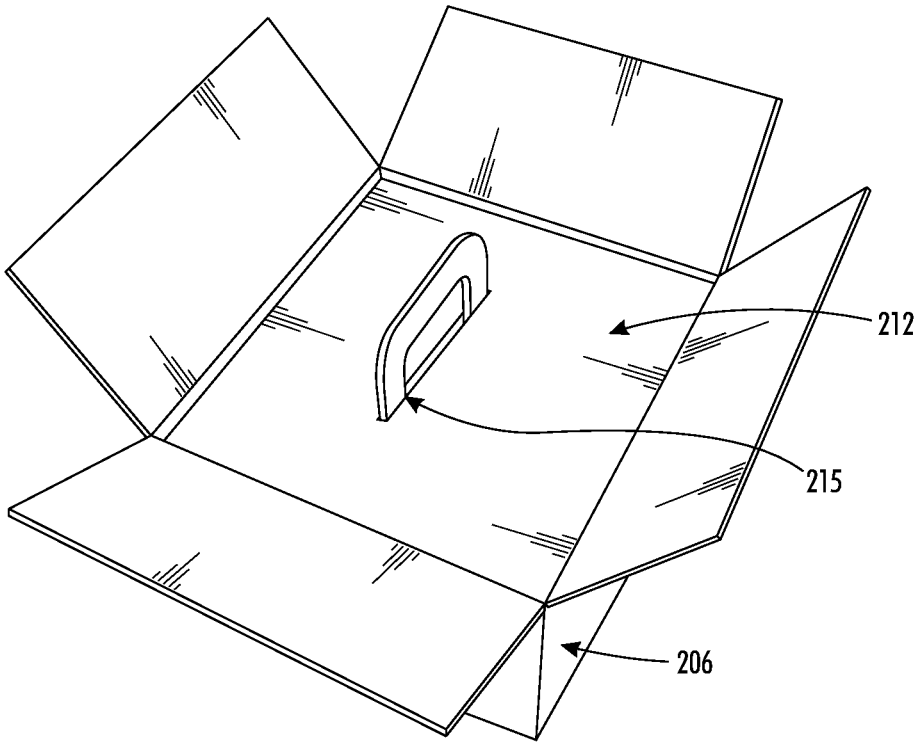
FIG. 2 shows a delicate filter packaging apparatus in accordance with an exemplary embodiment.

A packaging apparatus in accordance with an embodiment is shown in FIG. 2. For example, a packaging apparatus may include an outer shipping carton 205 that is configured to contain a filter wrap having a side wrap 212. A handle 215 may be configured to extend from the side wrap 212. The side wrap may be arranged to contain a filter such as the filter shown in FIGS. 1A-1B. The packaging apparatus may be comprised of any material suitable for packaging, such as, for example cardboard. Packaging apparatus may comprise, for example, 32 ECT "C" flute corrugated board with a kraft outer liner. A side and bottom of packaging apparatus may be formed to have a same thickness.

The filter wrap may be contained inside of the outer shipping carton 205 for shipping. The handle 215 may be used for inserting and removing the filter-containing filter wrap in and from the shipping carton 205. Accordingly, the handle 215 may prevent a customer from reaching into the packaging and puncturing or otherwise damaging the filer media. The handle 215 also may accommodate removal of the filter wrap from the outer shipping carton without requiring that the filter itself be grasped for removal thereof.

Figure 3A:
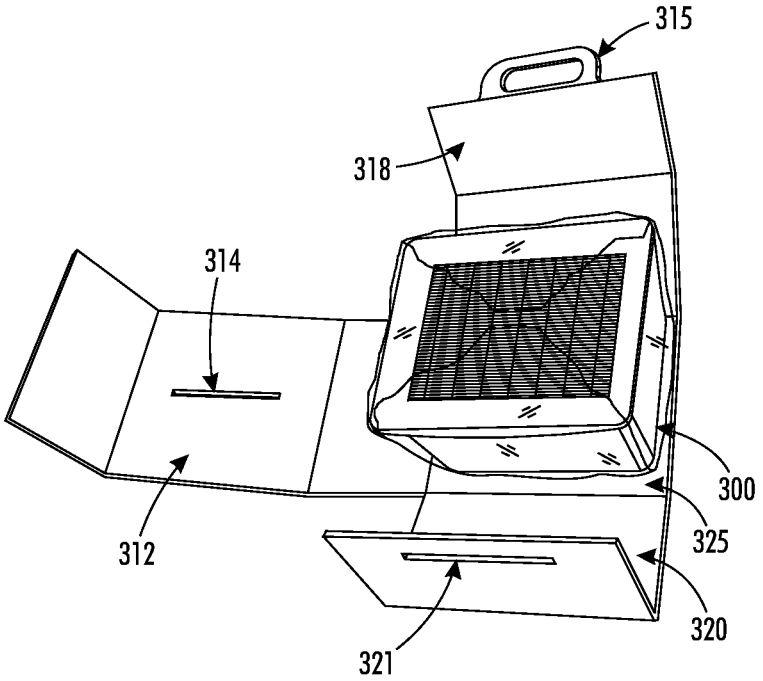
FIG. 3A shows a delicate filter packaging apparatus in accordance with an exemplary embodiment.

FIG. 3A shows a packaging apparatus in accordance with an embodiment. In particular, FIG. 3A shows a filter wrap for wrapping a filter. The filter may have a protective covering 300 such as plastic. The filter wrap may have a side wrap 312. The side wrap 312 may define a slit 314 for receiving a handle 315. In the embodiment shown in FIG. 3A, the handle 315 is formed on a rear wrap 318. A front wrap 320 may define a slit 321, which may be configured to receive the handle 315. A filter may rest on a base 325, which may provide support to a filter contained by the filter wrap. For example, the protective covering 300 may be removed from the filter while the filter rests on the base 325.

The side wrap 312 may extend from a first side of the base 325. The rear wrap 318 may extend from a second side of the base 325 in a direction perpendicular to a direction in which the side wrap 312 extends from the base 325. The front wrap 320 may extend from a fourth side of the base in a direction opposite from the direction in which the rear wrap 318 extends. A third side of the base 325, opposite from the first side, may not have a wrap extending therefrom. Rather, the side wrap 312 may extend a distance that accommodates wrapping of the side wrap 312 over a filter positioned on the base 325, and around the filter to meet the third side of the base 325.

The side wrap 312, rear wrap 318, and front wrap 320 may be configured so that to package a filter, the rear wrap 318 may be positioned to cover the rear and top portions of a filter. The side wrap 312 may then be positioned to cover a first side of the filter, and top of the filter, the handle 315 being passed through the slit 314. Then, the front wrap 320 may be positioned to cover a front and top of the filter, the handle 315 being passed through slit 321.

The wrapped filter may be carried by the handle 315, and may be supported by the base 325 during packaging and unpacking. For example, the handle 315 may used to lift the filter wrap and filter into and out of an outer shipping carton. The filter may rest on the base 325 during unpacking while, for example, packaging materials are removed from the filter prior to installation of the filter into a printing system. The filter wrap may be formed of, for example, cardboard, or similar suitable materials. The filter wrap may comprise material suitable for packaging. For example, the filter wrap may comprise 32 ECT "C" corrugated fiber board. The filter wrap comprise other ECT value boards, e.g., 26 or 44. Further, the filter wrap may comprise B, E, F, and A flutes. The filter wrap may comprise a white liner. The filter wrap may comprise fiberboard.

Figure 3B:
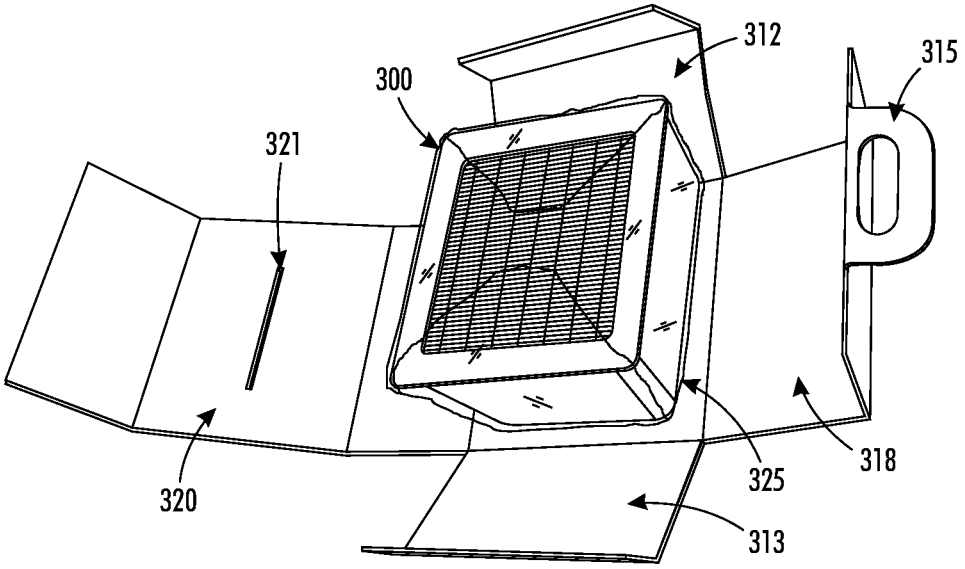
FIG. 3B shows a delicate filter packaging apparatus in accordance with an exemplary embodiment.

FIG. 3B shows a packaging apparatus in accordance with an exemplary embodiment. FIG. 3B shows a filter wrap for wrapping a filter. The filter may be wrapped in a protective covering 300, which may be formed of plastic, for example. The filter wrap may include side wraps 312 and 313. The filter wrap may include a front wrap 320 and a rear wrap 318. The rear wrap 318 may form a handle, and the front wrap 321 may define a slit configured for receiving the handle.

A filter may be supported by a base 325. The side wrap 312 may extend from a first side of the base 325. The side wrap 313 may extend from an opposite third side of the base 325. The rear wrap 318 may extend from a second side of the base 325 in a direction perpendicular to the direction in which the side wraps 312 and 313 extend. The front wrap 320 may extend from a fourth side of the base 325 in a direction opposite to the direction in which the rear wrap 318 extends.

The side wraps 312 and 313 may be positioned to cover the first and third sides of the filter. The rear wrap may be positioned to cover a side and top of the filter. Then, the front wrap 320 may be positioned over the filter to cover two opposing sides of the filter and the top of the filter, the handle passing through the slit 321. The wrapped filter may be carried by the handle 315. For example, the filter wrap may be inserted into and/or removed from an outer shipping carton by the way of the handle without damaging filter media.

Figure 4:
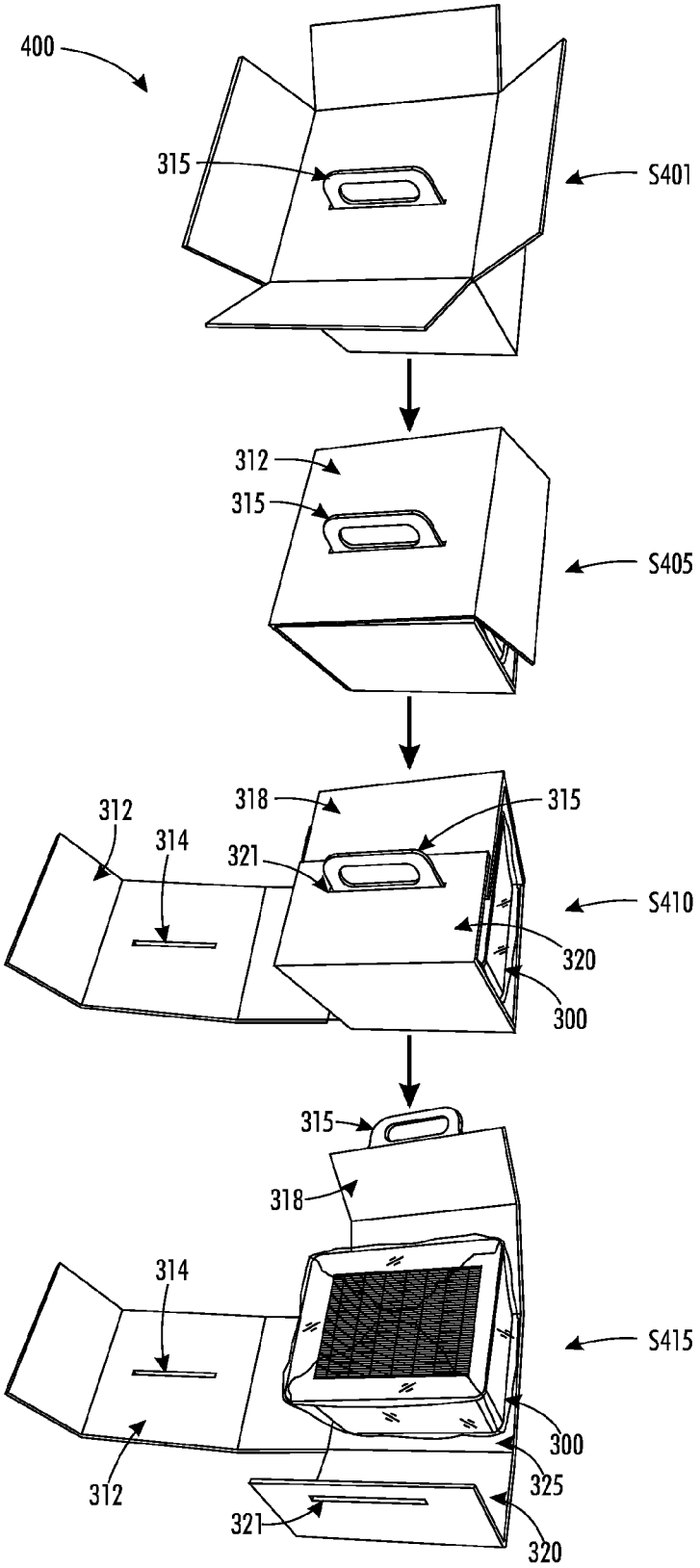
FIG. 4 shows a delicate filter packaging apparatus and packaging methods in accordance with an embodiment.

FIG. 4 shows an unpacking method in accordance with an exemplary embodiment. FIG. 4 shows a method 400 of packaging a filter in a filter wrap as shown in FIG. 3A. At S401, the filter wrap containing a filter may be removed from an outer shipping carton by way of handle 315. When the side wrap 312 is unwrapped, two opposite sides of the filter are exposed.

At S405, a side wrap 312 may be removed from covering a side and top of a filter. At S410, front wrap 320 may be removed from covering a side and top of the filter, the slit in the front wrap 320 sliding over the handle 315 for removal. The slit 314 may slide over the handle 315 as side wrap 312 is unwrapped from covering the filter. The front wrap 318 may be removed from covering a side and top of the filter, the entire filter being exposed thereby. At S415, the protective covering 300 may be removed from the filter while the filter rests on the base. A filter may be packaged using the steps shown in FIG. 4, in a reverse sequence. Further, the filter may rest on the base 325 as the filter protective covering 300 is removed, the base 325 providing support for the filter.

Figure 5:
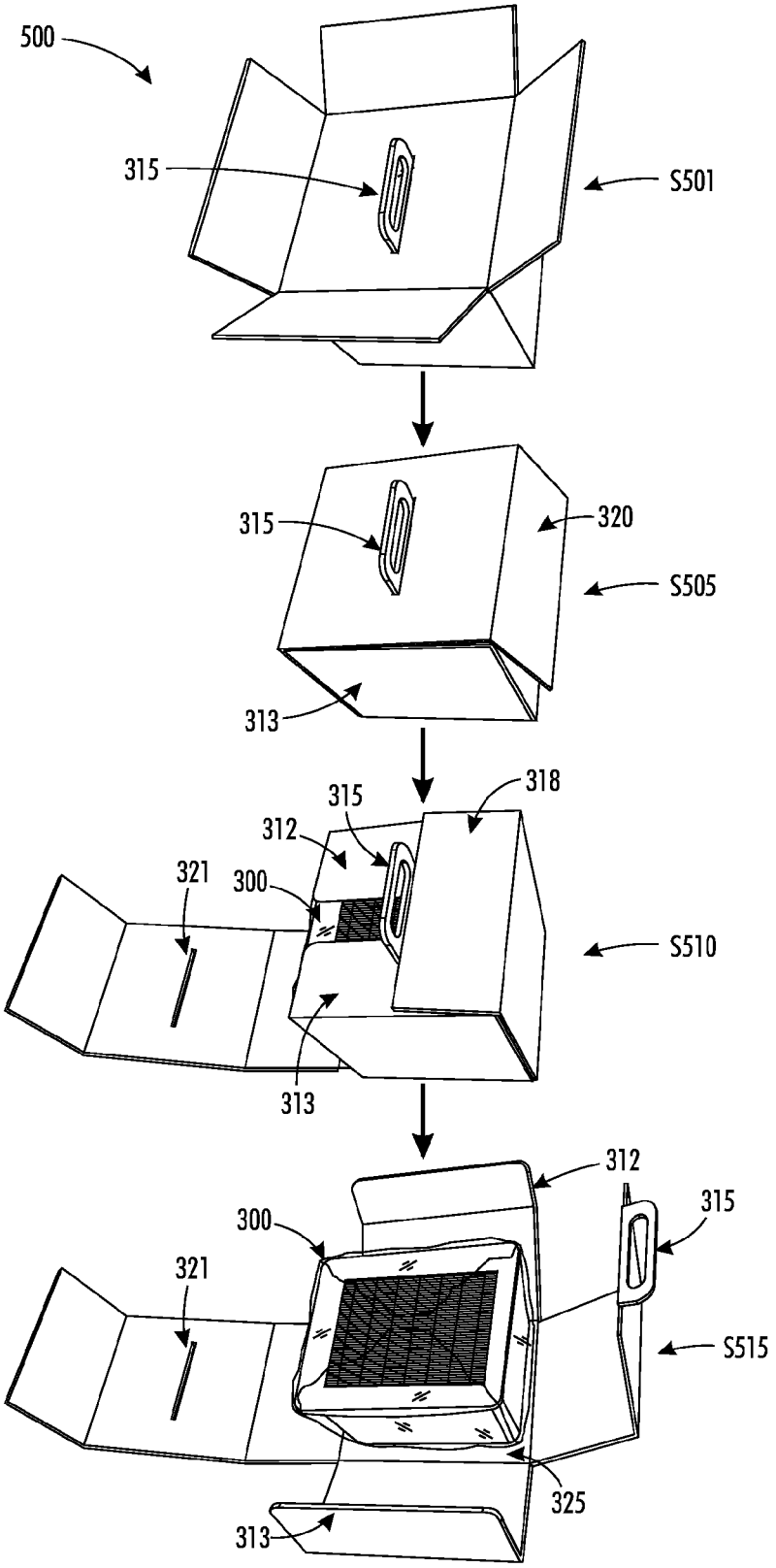
FIG. 5 shows a delicate filter packaging apparatus and packaging methods in accordance with an embodiment.

FIG. 5 shows a packaging method in accordance with an exemplary embodiment. FIG. 5 shows a method 500 of packaging a filter in a filter wrap as shown in FIG. 3B. At S501, the filter wrap containing a filter may be removed from an outer shipping carton by way of handle 315.

At S505, a front wrap 320 may be removed to uncover a side and top of the filter. A handle 315 may slide through a slit in the front cover 320. While the wrapped filter is carried, the front wrap 320 is being unwrapped, and while the wrap 320 is removed from the filter and extended as shown at S510, side wraps 312 and 313 may prevent the filter from sliding out of the filter wrap.

At S510, a rear wrap 318 may be removed from the filter, uncovering and exposing a top of the filter and a side of the filter. The handle 315 may be formed on the rear wrap 318. The handle 321 may be configured to pass through a slit 321, the slit 321 being defined by the front wrap 320.

At S515, the filter may be fully exposed, and resting on a base 325. The base 325 may be configured to support the filter. For example, the base 325 may be formed of a sturdy material that prevents the filter from dropping. The filter may be wrapped in a protective covering 300. The protective covering 300 may be removed while the filter rests on the base 325, so that the filter may be supported during removal of the protective covering 300, protecting the filter from damage by surrounding objects. At S515, side wraps 313 and 313 may be removed from the filter. Similarly, front wrap 320 defining the slit 321, and rear wrap 318 having the handle 315 attached thereto are removed from the filter, exposing the filter, which rests on the base 325.

While methods, apparatus, and systems for delicate filter media packaging apparatus and systems are described in relationship to exemplary embodiments, many alternatives, modifications, and variations would be apparent to those skilled in the art. Accordingly, embodiments of the methods and apparatus as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A filter packaging apparatus, comprising:

a substantially planar base formed from one and only one panel, the base having a substantially planar surface configured for supporting a filter, the base having a first side edge, a second side edge, a third side edge, and a fourth side edge;

a side wrap extending from the first side edge of the base, the side wrap defining a first slit;

a rear wrap extending from a second side edge of the base;

a front wrap extending from the fourth side edge of the base, the fourth side edge of the base being opposite from the second side edge of the base, the front wrap defining a second slit; and a handle, the handle being configured for holding a filter wrapped in the filter packaging apparatus, the handle being attached to the rear wrap.

2. The apparatus of claim 1, wherein the side wrap is configured for wrapping the filter by covering a first side of the filter, a top of the filter, and a second side of the filter, the second side of the filter being opposite from the first side of the filter.

3. The apparatus of claim 1, comprising the first slit being configured to receive the handle, wherein when the side wrap covers the top of the filter and the rear wrap covers the top of the filter, the side wrap and the filter are interposed by the rear wrap.

4. The apparatus of claim 1, comprising the second slit being configured to receive the handle, wherein when the side wrap covers the top of the filter, the front wrap covers the top of the filter, and the rear wrap covers the top of the filter, the front wrap interposes the side wrap and the rear wrap.

5. The apparatus of claim 1, comprising the side wrap being configured to contact two sides of the filter when the side wrap contacts the top of the filter.

6. The apparatus of claim 1, comprising the base being configured to support the filter, the filter having filter media comprising flame retardant borosilicate glass.

7. The apparatus of claim 1, the third side edge of the base being a free edge.

8. The apparatus of claim 1, the first slit being fully enclosed within the side wrap, and the second slit being fully enclosed within the front wrap.

9. The apparatus of claim 1, the handle directly extending from the rear wrap, the handle configured to slide through both the first slit and the second slit to close the filter packaging apparatus about the filter.

10. The apparatus of claim 9, the first side edge extending from the second side edge to the fourth side edge, the second side edge extending from the first side edge to the third side edge, and the fourth side edge extending from the third side edge to the first side edge, the side wrap being a unitary member having a folding edge there-through pivotally connecting a first portion of the side wrap extending from the entire first side edge of the base to a second portion of the side wrap extending from the first portion, the front wrap being a second unitary member having a folding edge there-through pivotally connecting a first section of the front wrap extending from the entire fourth side edge of the base to a second section of the front wrap extending from the first section.

11. The apparatus of claim 9, the first slit having a first length, the second slit having a second length, and the handle having a width, the first and second lengths both being greater than the width of the handle.

12. A filter packaging apparatus, comprising:

a substantially planar base formed from one and only one panel, the base having a first side edge, a second side edge, a third side edge, and fourth side edge;

a first side wrap extending from the first side edge of the base;

a second side wrap extending from a third side edge of the base, the third side edge of base being opposite from the first side edge of the base;

a rear wrap extending from a second side edge of the base;

a front wrap extending from the fourth side edge of the base, the fourth side edge of the base being opposite from the second side edge of the base, the front wrap having a distal free edge opposite the fourth side edge of the base and two front wrap side edges, one of the two front wrap side edges being a free edge extending from an intersection of the first side edge of the base and the fourth side edge of the base to the distal free edge, the other one of the two front wrap side edges being another free edge extending from an intersection of the third side edge of the base and the fourth side edge of the base to the distal free edge, the front wrap defining a slit; and a handle, the handle being configured for holding a filter wrapped in the filter packaging apparatus, the handle being attached to the rear wrap.

13. The apparatus of claim 12, wherein the first side wrap is configured for wrapping the filter by covering at least a first side of the filter and the second side wrap is configured for wrapping the filter by covering at least a third side of the filter, the third side of the filter being opposite from a first side of the filter.

14. The apparatus of claim 13, comprising the first side wrap being configured to contact the first side and the top of the filter.

15. The apparatus of claim 12, comprising the slit being configured to receive the handle, wherein when the front wrap covers the top of the filter and the rear wrap covers the top of the filter, the front wrap interposing the rear wrap and the filter.

16. The apparatus of claim 12, comprising the base being configured to support the filter, the filter having filter media comprising flame retardant borosilicate glass.

17. The apparatus of claim 12, the first and second side wraps both being unitary members having a folding edge there-through pivotally connecting two sections of the respective first and second side wraps.

18. The apparatus of claim 12, the handle directly extending from the rear wrap, the handle configured to slide through the slit to close the filter packaging apparatus about the filter.

19. The apparatus of claim 18, the first side edge extending from the second side edge to the fourth side edge, the second side edge extending from the first side edge to the third side edge, and the fourth side edge extending from the third side edge to the first side edge, the rear wrap being a unitary member having a folding edge there-through pivotally connecting a first portion of the rear wrap extending from the entire second side edge of the base to a second portion of the rear wrap extending from the first portion, the front wrap being a second unitary member having a folding edge there-through pivotally connecting a first section of the front wrap extending from the entire fourth side edge of the base to a second section of the front wrap extending from the first section, both of the two front wrap side edges extending directly from the fourth side edge of the base to the distal free edge.

* * * * *